US008672639B2

(12) United States Patent
Wallace

(10) Patent No.: US 8,672,639 B2
(45) Date of Patent: Mar. 18, 2014

(54) BILGE PUMP AND METHOD

(76) Inventor: William L. Wallace, McClellanville, SC (US)

( * ) Notice: Subject to any disclaimer, the term of this patent is extended or adjusted under 35 U.S.C. 154(b) by 432 days.

(21) Appl. No.: 12/930,367

(22) Filed: Jan. 5, 2011

(65) Prior Publication Data

US 2012/0171051 A1 Jul. 5, 2012

(51) Int. Cl.

| | |
|---|---|
| ***F04B 49/00*** | (2006.01) |
| ***F04F 1/06*** | (2006.01) |
| ***F04F 3/00*** | (2006.01) |

(52) U.S. Cl.

USPC ..... 417/36; 417/119; 417/121

(58) Field of Classification Search

CPC ... B63B 13/00; B63B 2013/00; B63J 2004/00
USPC ..... 95/24, 175, 266; 96/157, 193, 219; 141/65; 210/188, 258, 299, 303, 305, 210/320, 416.1; 417/36, 54, 118, 119, 121; 114/183 R

See application file for complete search history.

(56) References Cited

U.S. PATENT DOCUMENTS 4,045,336 A * 8/1977 Isteri ..... 210/629
6,174,146 B1 * 1/2001 Lacy et al. ..... 417/423.15

* cited by examiner

*Primary Examiner* — Bryan Lettman
(74) *Attorney, Agent, or Firm* — L. Lawton Rogers, III

(57) ABSTRACT

A vacuum assisted bilge pump small enough for the crowded spaces below decks in the engine and pump room of a boat which can also function as a transfer pump, a crash pump and a fire extinguisher. The pump comprises two chambers and is internally configured to aid in the separation of gas and liquid increasing pump throughput.

18 Claims, 3 Drawing Sheets

BILGE PUMP AND METHOD

FIELD OF THE INVENTION

The present invention relates to bilge pumps, and more particularly to a vacuum assisted pump for pumping bilge fluids from a boat.

BACKGROUND OF THE INVENTION

Boats of any appreciable size have bilges where any liquid introduced into the boat collects under the force of gravity. These liquids may, e.g., be fresh or sea water, oil or gasoline from the propulsion system or on-board machinery, etc. Solids may also find their way into the bilge. Such combinations of liquids and solids will be referred to herein as "bilge liquids". The retention of bilge liquids on board a boat is highly undesirable, as it may contain hydrocarbons and/or other engine compartment liquids in addition to water.

There may be several bilges in a boat where bilge liquids may collect. Because they are in the very bottom of the boat, bilges are generally very difficult to access. and it generally is not practical to collect bilge liquids in a bucket or other container which may be carried through confined spaces and up ladders for disposal above deck. For this reason, bilge pumps are generally connected by flexible hose or rigid conduit to an overboard discharge. Bilge pumps typically are unable to distinguish between environmentally safe and unsafe liquids and the discharge thereof into the waterways creates additional problems.

In addition to the purging of bilge liquid from the bilges, there are spills of liquids of various types below decks, e.g. an oil leak in a piece of machinery, fuel leaks, or the accidental overturn of a coffee pot.

Finally, there are occasions when a boat may strike a submerged object or collide with another boat or a pier, breaching the hull to permit the introduction of water. To keep the boat afloat, it is highly desirable that the bilge pump be operable as a "crash" pump with a high pumping capacity and that it be substantially continuous in operation.

Commonly, bilge pumps comprise an electric motor driven, self-priming, pump, generally self actuating in responsive to a float switch to purge the bilge of bilge fluid. Such pumps are often mounted in the bilge areas, but they may also be located in a convenient space in the boat remote from the bilge, e.g., a below deck engine room or pump room where machinery is located. Such remote bilge pumps may be in communication with permanently installed bilge intakes in various of the bilges and with an overboard discharge conduit.

The liquid intake for the typical bilge pump is mounted proximate to the hull with a sensor, typically a float switch, which responds to the level of liquid in the bilge to turn the pump on and off. Such pumps, being positive displacement pumps and responsive to a predetermined liquid level, cannot completely drain the bilge. Moreover, the seals of the pump must be moistened to prevent excessive wear and replacement, a task often difficult in the confined space of a bilge or the engine room compartment of a boat.

Installation of bilge pumps is often difficult due to the tight quarters of the engine compartment or bilge area. Mounting the bilge pump to the hull, connecting the electrical wiring, and connecting the pump outlet to the drain conduit are all complicated by the confined working space. Replacing an inoperable bilge pump may even be more difficult. Replacement bilge pumps usually have a mounting footprint and overall configuration that is different from the original pump so that the wiring and drain conduits, designed to accommodate the original bilge pump, may not be compatible.

Vacuum systems are needed to completely remove bilge liquid from the bilges and/or to remove spills from other areas. It is known to provide a vacuum bilge system to supplement a conventional high volume liquid bilge pump. One such system is disclosed in the Baurley U.S. Pat. No. 6,837,174 wherein the residual bilge liquid is collected in a collection chamber under a negative pressure, and then discharged from the collection chamber under a positive pressure.

Others have attempted to address this problem in small boats by using small portable vacuum cleaners. Such portable vacuum cleaners are not connected to overboard discharges and generally have a very small storage capacity in a single chamber. This means that the operator must frequently stop the vacuuming process to manually take the collected liquid from the bilge or engine room on deck for disposal.

To the knowledge of applicant, applicant is the first to use a vacuum to collect bilge liquid into a container and to simultaneously use a centrifugal pump to discharge the bilge liquid from the container.

Large portable vacuum cleaners known as "shop-vacs" or "wet-vacs' are known in non-marine environments, and are used for emptying spas or hot tubs. Typically, a single chamber is sealed by a top that has a vacuum pump depended therefrom so as to be located within the container. Air is pumped from the container through the top to create a negative pressure within the container, which is used to draw air and liquids into the container through a hose connected to the side wall of the container. A liquid pump located within the container is used to discharge liquid, typically through a garden hose.

There are a number of reasons why such "wet-vacs" are not suitable for use in marine environment, and particularly aboard a boat as a bilge pump. The use of a single chamber into which air and liquid is drawn and from which air and liquid is pumped gives rise to a number of problems. By way of example, the highly mixed air and liquid and the location of the air intake for the vacuum pump well down inside the chamber often results in liquid in the vacuum pump. In addition, the air in the air/liquid mixture within the chamber often results in an air lock of the liquid pump. These two problems become less severe as the chamber becomes larger, i.e., there is more space and hence more time for the liquid to separate from the air under the influence of gravity. Because the engine or pump rooms of a boat are accessible only through narrow passageways, typically down steps and around tight corners, large containers are not practical. Even if moved into an engine room in pieces and assembled there, there is insufficient room for the assembled vacuum cleaner.

Even if the liquid and vacuum pumps remain operational, the liquid level within the compartment must be carefully regulated—too much liquid increases the risk of liquid into the vacuum system and too little liquid dries the seals of the liquid pump. The liquid level control for such systems is generally a float switch, e.g., a caged ball at the mouth of the vacuum pump. Once the liquid in the chamber floats the ball into the mouth of the vacuum pump, the vacuum pump will hold it there effectively shutting down the introduction of fluid into the chamber until the vacuum pump is shut down permitting the caged ball to drop away from the vacuum pump. Such systems typically require constant operator attention, generally unavailable on a boat.

There is thus a long felt need to provide a bilge pump sufficiently small for use in the confined spaces aboard a boat that is portable, or at least easily installed and removable for replacement, that is capable of removing essentially all liquid from the bilge.

In one aspect, the bilge pump of the present invention utilizes two chambers, and the physical configuration of those chambers, to effect separation of air from the bilge liquid.

In another aspect, the bilge pump of the present invention provides independent control of both bilge liquid intake and bilge liquid discharge to insure optimization of bilge liquid throughput. These controls are also utilized to prevent both vapor lock of the liquid pump the receipt of bilge liquid into the vacuum pump.

In a further aspect, the bilge pump of the present invention provides for both the complete draining of the chamber and for the utilization of the bilge pump as a high volume crash pump or fire extinguisher.

In yet a further aspect, the bilge pump of the present invention can selectively discharge the bilge liquid into a container in the case of hydrocarbons or overboard in the case of environmentally safe liquids.

In yet another aspect, the chambers of the bilge pump of the present invention are easily accessible and liquid can be poured into the top of the input chamber when the pump is used as a transfer pump; the basket filter may easily be removed for cleaning through the same opening; and the liquid pump may easily be removed for service or replacement from the bottom of the output chamber.

In yet another aspect, the bilge pump of the present invention may be used to selectively pump the liquid on which the boat floats as a fire extinguisher.

These and many other objects and advantages of the bilge pump of the present invention will be apparent to one of skill in marine bilge pumps from a review of the following drawings and detailed description of a preferred embodiment.

THE DRAWINGS

THE DETAILED DESCRIPTION OF A PREFERRED EMBODIMENT

Figure 1:
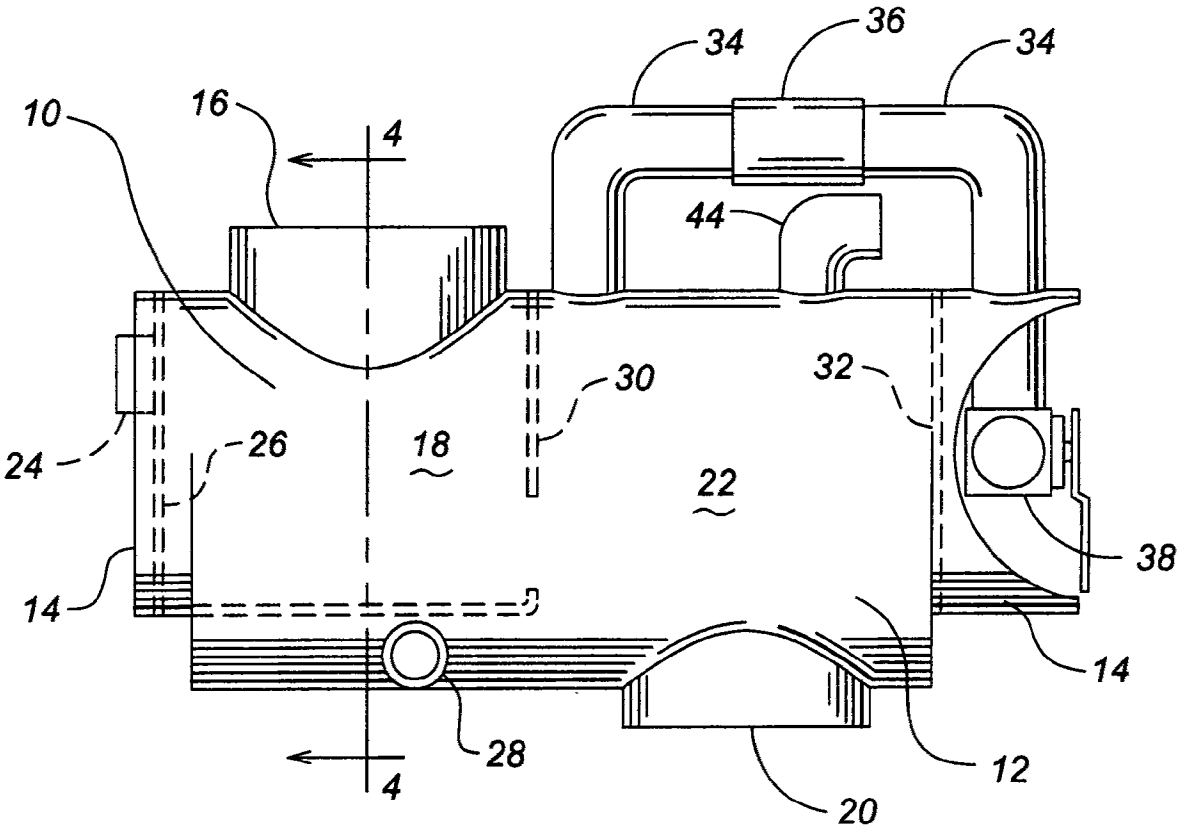
FIG. 1 is a pictorial representation of the left side of one embodiment of the bilge bump of the present invention with the internal chamber divisions shown in phantom.
Figure 4:
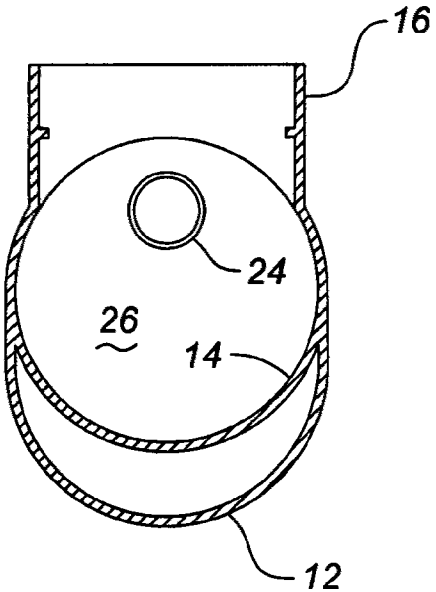
FIG. 4 is a section taken through lines 4-4 of FIG. 1.
Figure 2:
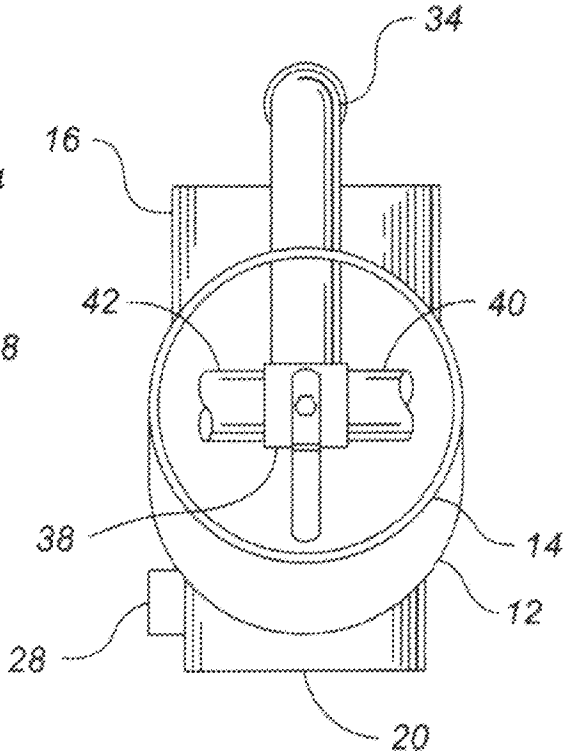
FIG. 2 is a pictorial representation of the right end of the embodiment of FIG. 1.

With reference to FIGS. 1-4 where like numerals have been used for like elements thereof, a preferred embodiment of the vacuum assisted bilge pump of invention is illustrated. The pump body may be molded but it has been found convenient to form the pump body from two sections, each approximately 8.5 inches in diameter, of a suitable non-corroding and electrically non-conducting pipe such as PVC or other plastic or fiberglass. The shorter section 12 is split through the longitudinal axis thereof and fused to the longer section 14 as illustrated. A cradle (not shown) may be provided to support the pump, and the pump may be integral with the cradle or removably mounted thereon. Movement of the cradle and pump may be facilitated by the use of conventional casters. (not shown)

A third section of pipe 16 approximately 7.25 inches in outside diameter is oriented vertically and is fused to the upper portion of section 14 adjacent the input or left end of the body 10, and the portion of the section 14 internal of the section 16 is removed so that the input chamber 18 may be accessed through the pipe 16 in the top thereof.

A fourth section of pipe 20 approximately 6.5 inches in diameter is oriented vertically and is fused to the lower portion of section 12 adjacent the output or right end of the body 10, and the portion of the section 12 internal of the section 20 is removed so that the output chamber 22 may be accessed through the pipe 20 in the bottom thereof.

The input conduit 24 is provided for the input chamber 18. This conduit 24 may also be a short section of pipe approximately 1.25 inches in diameter fused to the input or left wall 26 around an aperture therein. The outer end of the input conduit 24 may be provided with any suitable and conventional fitting (not shown) including a quick disconnect for the connection to a permanently installed conduit system in fluid communication with various locations in the bilge, engine room or pump room or with a manually positionable flexible conduit (not shown) selectively positioned by an operator for the removal of spills.

A drain conduit 28 for the output chamber 22 is also provided. This may also be a short section of pipe approximately 1.25 inches in diameter fused to the shorter pipe section 12 and in fluid communication with the sump at the bottom thereof. The drain conduit is approximately 4 inches long because it communicates with the very bottom of the chamber facilitating the removal by gravity flow of all of the bilge liquid from the output chamber 22. The drain conduit 28 does not protrude laterally beyond the sections 12,14, and may be provided with a suitable conventional plug selectively removable to drain the sump of the output chamber 22. The distal end of the drain conduit 28 may be provided with any suitable and conventional fitting (not shown) including a quick disconnect for the connection to an overboard discharge conduit (not shown).

In the event of a catastrophic failure that causes the bilge to fill, there is often a lot of debris in the water. Such debris may quickly cause the conventional bilge pumps to clog. Since it is generally difficult to clear the debris because of the remote and likely underwater location of conventional bilge pumps, the pumps may fail and hasten the sinking of the vessel The bilge pump of the present invention provides a secondary emergency system with significant pumping capacity, typically about 20 gallons per minute. Because the bilge pump of the present invention is typically located above the bilges, the cap of the drain conduit 28 can be removed and any liquid that rises to the level of the drain conduit 28 will flow directly into the output chamber for discharge overboard. This direct access of liquid will bypass all of the debris strainers in the bilge pump and except for the one conventionally associated with the input to the pump itself.

The pump of the present invention may also be used as a fire extinguisher, in which a conduit (not shown) accessing a below waterline through-hull fitting may be selectively connected to the drain conduit 28 and a hose (not shown) connected to the conduit 42 of the diverter valve 38. In this way, the water on which the boat floats may be pumped with or without the application of a negative pressure into the boat to extinguish a fire.

As shown in FIG. 1, the input chamber 18 is separated from the output chamber 22 by the bottom of the pipe section 14 and a vertical wall 30 which depends from the top of the pipe section 14, leaves the lower third of the pipe 14 open and thus in fluid communication with the output chamber 22. The output or right end of the output chamber 22 is closed by a wall 32.

With continued reference to FIGS. 1-4, the liquid output conduit 34 is attached to the pump and extends through an aperture in the top of the left or output side of the output chamber 22. The conduit 34 may be sealed to section 14 with a suitable sealant, removable to facilitate the removal of the pump. This liquid output conduit 34 extends along the length of the section 14 and desirably contains a one-way or check valve 36 to prevent the introduction of liquid into the output chamber. The conduit 34 then drops to a suitable conventional diverter valve 38.

Figure 7:
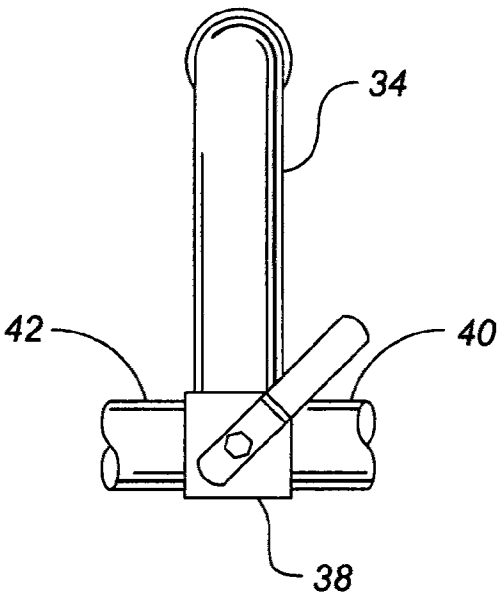
FIG. 7 is a pictorial view of the diverter valve at the right end of the embodiment of FIG. 1.

As shown more clearly in FIG. 7, the valve 38 may be used to selectively divert liquid from conduit 34 into either an overboard discharge conduit 40 or to a tap 42 where the liquid may be collected in suitable container for disposal other than overboard. Any suitable conventional fitting or quick disconnect may be used to effect the coupling of the diverter valve 38 to the conduit 40 or the tap 42.

With reference again to FIG. 1, the vacuum outlet conduit 44 may also be a short section of pipe approximately 1.5 inches in diameter fused to the longer section 10 and in fluid communication with the outlet chamber 22 at the top thereof at the right side thereof. The outer end of the vacuum outlet conduit 44 may be provided with any suitable and conventional fitting (not shown) including a quick disconnect for the connection to a suitable conventional vacuum pump (not shown) located proximate to the bilge pump or remotely as may be convenient in a particular installation. The function of the vacuum pump is to create a suitable negative pressure in the output chamber 22 through conduit 44. The negative pressure in the output chamber 22 creates a negative pressure in the input chamber 18, and in turn through the input conduit 24 to the bilge.

Figure 5:
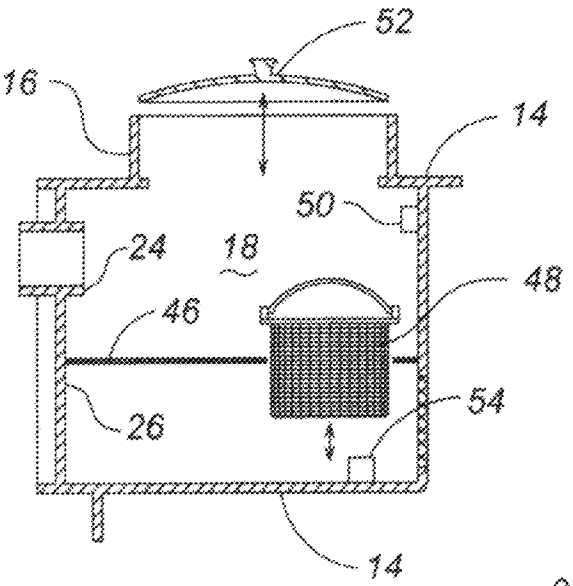
FIG. 5 is a longitudinal section of the input chamber of the embodiment of FIG. 1.
Figure 3:
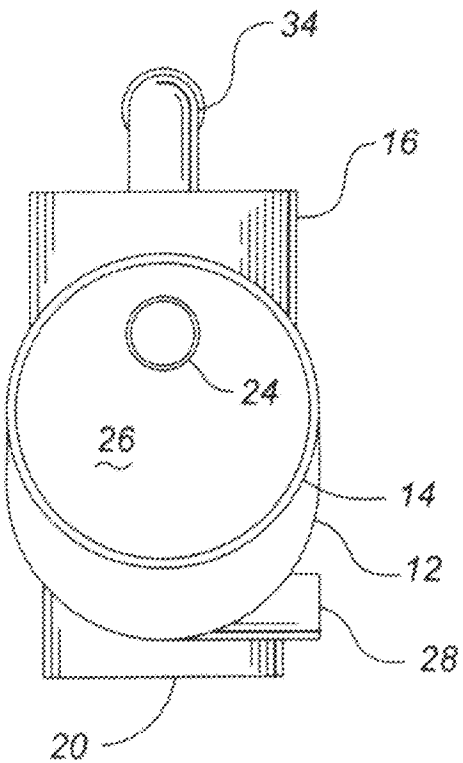
FIG. 3 is a pictorial representation of the left end of the embodiment of FIG. 1.
Figure 6:
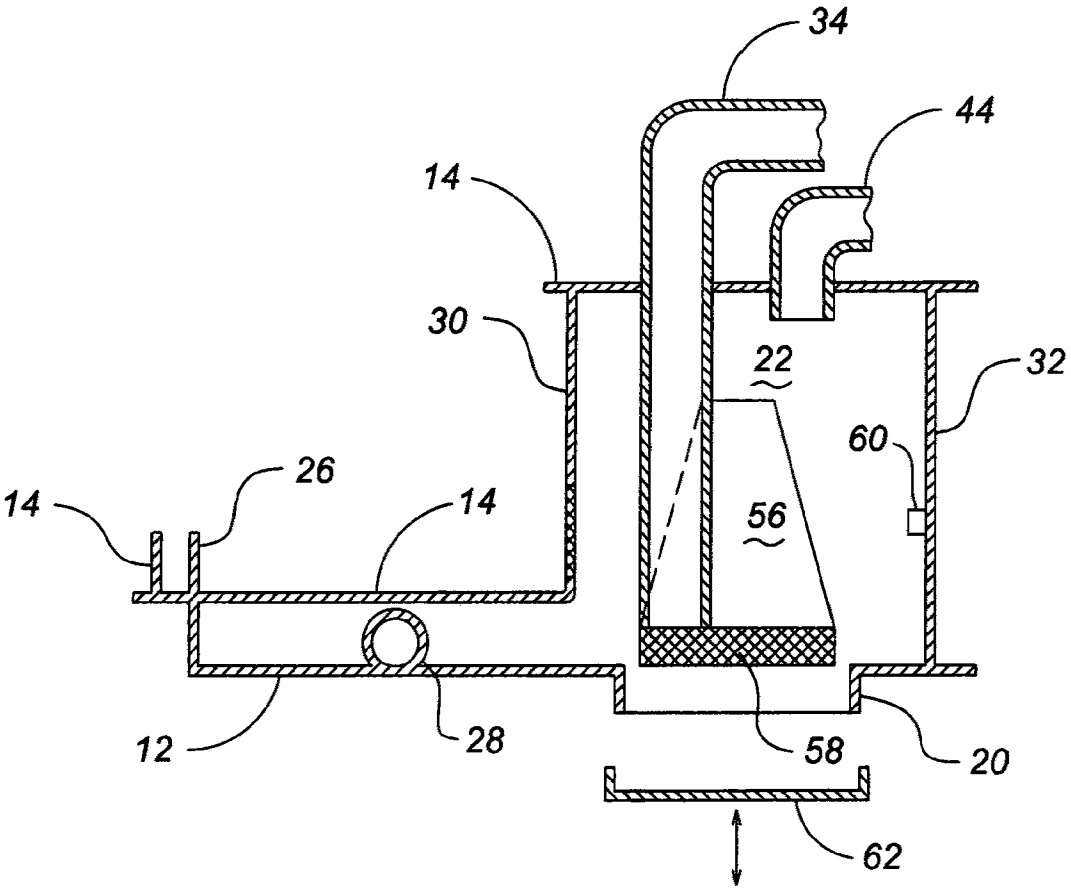
FIG. 6 is a longitudinal section of the output chamber of the embodiment of FIG. 1.

The operation of the pump of the present invention may be more readily understood by reference to FIGS. 5 and 6. In FIG. 5, it may be seen that there is a generally horizontal screen 46 that divides the input chamber 18 into top and bottom compartments. This screen 46 may include an opening into which a basket 48 may be inserted. Bilge fluid may contain solid objects such as nuts and washers that are inadvertently dropped into the bilge as well as other debris that will not pass through the liquid pump. The mesh of the screen and basket are desirably the same so that solid objects that will not pass through the liquid pump are retained above the screen and find their way into the basket. The basket 48 is easily removed from the input chamber 18 through the opening provided by pipe section 16. The opening in the wall 30 dividing the two chambers 18,22 may also be provided with a screen as further protection for the liquid pump.

The relatively large diameter opening in the top of the input chamber is advantageous in avoiding spills when the pump is being used as a transfer pump, i.e. i.e., when liquids are poured into the input chamber 18 rather than vacuumed therein from the bilges.

A source of illumination 50, desirably a blue diode, may be mounted on the right wall 30 to provide illumination to the input chamber 18 when the system is operational. A cover plate 52 may be provided and will be retained in place by gravity and the negative pressure within the input chamber 18. By making the cover plate 52 transparent or translucent, a blue glow from the diode may be seen from across the engine room, indicating to the observer that the system is operational.

In operation, a negative pressure in the input chamber 18 will draw bilge fluid therein through the input conduit 24. The bilge fluid enters at a high velocity and is sprayed against the wall 30 where it creates significant turbulence in the top half of the chamber. Solids are removed as the fluid, beginning to separate into gas and liquid components under the influence of gravity, passes through the screen into the lower half of the chamber 18 under the influence of the negative pressure. Further separation of the gas from the liquid occurs in the lower half of the chamber 18 as both pass through the wall 30 into the output chamber 22. Thus the configuration of the input chamber 18, including the baffles formed by the wall 30 and the bottom portion of the section 10, acts as a liquid/gas separator.

In operation, the separating air and liquid in the input chamber 18 will be drawn through the wall 30 into the output chamber 22, with the air being drawn through the top of the opening in the wall 30 under the influence of the negative pressure in the output chamber 22, and the liquid being drawn through the bottom of the opening in the wall 30 primarily under the influence of gravity. A suitable conventional liquid sensor 54 may be provided in the bottom of the input chamber 18 to suspend the operation of the liquid pump 56 in the output chamber 22 in the absence of liquid flowing into the output chamber 22. Alternatively, the sensor 54 could be physically located in the output chamber 22 and perform the same function.

With reference to FIG. 6, gas and liquid enter the output chamber from the input chamber 18 through the screen in the wall 30 as described in connection with FIG. 5. As earlier noted, there is a portion of the output chamber 22 that extends under the input chamber 18. Liquid entering the output chamber contains very little gas and collects in the lower part of the section 12 which acts as a sump. A suitable conventional liquid sump pump 56 is positioned in the output chamber 22 with the liquid intake portion 58 desirably below the bottom of the opening in the wall 30. In this way, the pump 56 will draw fluid only from the sump, fluid which is substantially devoid of gas because of the configuration of the input and output chambers 18,22. The pump 56 pumps liquid upward through liquid output conduit 34 to the diverter valve 38 shown and described in connection with FIG. 7. As earlier indicated, the check valve 36 prevents the flow of liquid back into the output chamber 22.

With continued reference to FIG. 6, gas entering the output chamber 22 through the screen in the lower part of the wall 30 is drawn upward by the negative pressure in the vacuum conduit 44 at the top of the output chamber 22. A suitable conventional sensor 60 is desirably provided in the output chamber 22 so that the accumulation of liquid to a level where liquid may be drawn into the vacuum system can be avoided. This may be accomplished by suspension of the operation of the vacuum system for the very brief time required for the liquid pump 56 to catch up in the absence of continuous liquid input to the input chamber 18. The electrical wiring to the sensors, power for the pump 56, and control circuits have been omitted from the figures as conventional and well within the skill of the artisan in this field.

The drain conduit 28 may be opened to completely drain the sump when the bilge pump is not is use. The pump 56 may be removed for service through the section 20 as needed by removal of a conventional cover plate 62.

ADVANTAGES AND SCOPE OF INVENTION

From the foregoing, it can be seen that the vacuum assisted pump of the present invention is advantageous over known systems in that, in addition to its primary function as a remote bilge pump, it can also be used as a transfer pump, a crash pump, a pump for spills and as a fire extinguisher. The output discharge is easily switched between overboard discharge and a container. The various parts thereof are readily accessible for ease in repair. The pump may be completely drained.

The two chamber design serves as an air/liquid separator greatly improving the throughput of the pump, as does the independent control of the bilge fluid input and discharge.

These and many other objects and advantages will be readily apparent to one of skill in the bilge art. The embodiment disclosed is illustrative only and the scope of the invention is to be determined only by reference to the appended claims when given a wide range of equivalents.

What is claimed is:

1. A vacuum bilge pump for a boat comprising an integral housing with input and output internal chambers of substantially the same volume, said input chamber having an upper and a lower portion separated by a screen for solid particulates above a predetermined size, said input chamber having a bilge liquid input in the upper portion thereof being adapted to communicate with a source of bilge liquid so as to selectively draw bilge liquid therein when a negative pressure is applied interiorly of said input chamber, said input chamber having a fluid output in the lower portion thereof communicating with a lower portion of said output chamber, said bilge liquid input and said fluid output being on opposite sides of said screen, said output chamber having a sump portion in the lower portion thereof that extends under said input chamber, said output chamber having a gas output in an upper portion thereof adapted for communication with a vacuum source so that a negative pressure may be applied from a vacuum source to an interior of said output chamber and through said fluid output to said input chamber to draw bilge liquid into said input chamber through said bilge liquid input; and a liquid pump mounted internally of said output chamber capable of pumping entrained solids small enough to pass through said screen, said pump (a) being in communication with the sump portion of said output chamber so as to draw liquid therefrom at a height below [the bottom of] said input chamber, and (b) having a discharge conduit extending through the upper portion of said output chamber adapted for selective connection to an overboard discharge conduit.

2. The vacuum bilge pump of claim 1 further including a one-way valve in said discharge conduit to prevent the introduction of liquid into said vacuum source; and including a diverter valve in said discharge conduit so that fluid passing therethrough may be selectively diverted from the overboard discharge conduit.

3. The vacuum bilge pump of claim 2 wherein said bilge fluid input, said fluid output and said diverter valve are generally aligned along a longitudinal axis of said housing; and wherein the maximum horizontal dimension of said housing does not exceed about 24 inches so that said vacuum bilge pump may pass through a typical narrow entrance to an engine room of a boat.

4. The vacuum bilge pump of claim 1 further including a sensor in one of said chambers for interrupting the application of the negative pressure to the interior of said output chamber in response to the a liquid level therein that increases the risk of liquid passing into said gas output.

5. The vacuum bilge pump of claim 1 further including a sensor in said input chamber for interrupting the operation of said liquid pump.

6. The vacuum bilge pump of claim 1 wherein said screen includes a manually removable basket; and wherein said housing includes a removable section in the top of said input chamber so that said basket may be withdrawn therethrough to remove any solids in the bilge fluid that do not pass through said screen.

7. A vacuum bilge pump for a boat comprising:

an input chamber for receiving bilge liquid, separating received gas from said received bilge liquid and passing the separated gas and liquid to an output chamber, received gas being separated from said received bilge liquid solely by the physical configuration of said input chamber, a liquid pump in said output chamber for removing liquid therefrom; and a source of negative pressure in communication with said output chamber for removing gas therefrom.

8. In a vacuum bilge pump for a boat having (a) a housing adapted for fluid communication with a source of negative pressure and a source of bilge liquid and (b) a liquid pump carried interiorly of said housing in fluid communication with an overboard discharge, the improvement wherein said housing includes an input and an output chamber, said input chamber receiving the bilge liquid adjacent the top thereof and being in fluid communication adjacent the bottom thereof with said output chamber, said output chamber being in fluid communication at the top thereof with said source of negative pressure, and said pump being in said output chamber and in fluid communication with the overboard discharge to discharge bilge liquid from the bottom of said output chamber.

9. The pump of claim 8 wherein bilge liquid is discharged from said output chamber at a height below said input chamber.

10. The pump of claim 8 including baffle means, and wherein bilge liquid is received into said input chamber in a direction generally facing the point of fluid communication of said input chamber with said output chamber on opposite sides of said baffle means.

11. The pump of claim 8 including means for controlling the application of negative pressure to said input chamber as a function of the volume of liquid in said input chamber, and including means for controlling the application of negative pressure to said output chamber in response to the volume of liquid in said output chamber.

12. The vacuum bilge pump for a boat of claim 8 including a sensor of the volume of liquid in said output chamber; and means responsive to said sensor for controlling said source of negative pressure.

13. A method of removing bilge fluid from a boat comprising the steps of:

(a) introducing bilge fluid into an input chamber;

(b) separating gas and liquid components of the bilge fluid;

(c) introducing the separated gas and liquid components into a output chamber; and (d) separately removing the gas and liquid components from the output chamber, wherein the gas and liquid components of the bilge fluid are separated solely by the interaction between the bilge fluid and the static physical configuration of the input chamber under the influence of gravity as the bilge liquid passes through said input chamber.

14. A method of removing bilge fluid from a boat comprising the steps of:

(a) introducing bilge fluid into an input chamber;
(b) separating the gas and liquid components of the bilge fluid;
(c) introducing the separated gas and liquid components into a output chamber; and
(d) separately removing the gas and liquid components from the output chamber wherein a rate of introduction of bilge fluid into the input chamber is controlled solely by the rate of removal of said liquid component from the output chamber.

15. A method of removing bilge fluid from a boat comprising the steps of:

(a) introducing bilge fluid into an input chamber;
(b) separating gas and liquid components of the bilge fluid;
(c) introducing the separated gas and liquid components into an output chamber; and
(d) separately removing the gas and liquid components from the output chamber wherein a rate of introduction of bilge fluid into the input chamber is the sole function of the amount of liquid in the output chamber.

16. A vacuum transfer pump for a boat comprising an integral housing with input and output internal chambers, said input chamber having a bilge liquid input in the upper portion thereof for selectively receiving bilge liquid in response to the application of a negative pressure therein and a removable top to selectively receive by gravity liquids to be transferred, said output chamber having (a) a sump in the lower portion thereof for selectively receiving liquids by gravity from one of (i) the interior and (ii) the exterior of the boat, and (b) a gas output in the upper portion thereof adapted for communication with a vacuum source, said input and output chambers being in fluid connection adjacent the bottoms thereof so that liquids received into said input chamber by vacuum or by gravity are transferred to said output chamber by one or more of vacuum and gravity; and a liquid pump mounted internally of said output chamber including a liquid outlet conduit extending through the upper portion of said outlet chamber for discharging liquids.

17. The pump of claim 16 including a valve by which the liquid discharged from said output chamber may selectively be discharged as an overboard discharge, discharged into a container and sprayed as a fire extinguisher.

18. A vacuum bilge pump for a boat comprising an integral housing with input and output internal chambers, said input chamber having an upper and a lower portion separated by a screen for solid particulates above a predetermined size, said input chamber having a bilge liquid input in the upper portion thereof being adapted to communicate with a source of bilge liquid so as to selectively draw bilge liquid therein when a negative pressure is applied interiorly of said input chamber, said input chamber having a fluid output in the lower portion thereof communicating with a lower portion of said output chamber, said bilge liquid input and said fluid output being on opposite sides of said screen, said output chamber having a sump portion in the lower portion thereof lower than said input chamber, said output chamber having a gas output in the upper portion thereof adapted for communication with a vacuum source so that a negative pressure may be applied from a vacuum source to the interior of said output chamber and through said fluid output to said input chamber to draw bilge liquid into said input chamber through said bilge liquid input;

means for controlling the application of negative pressure to said output chamber in response to the volume of liquid in said output chamber, and a liquid pump mounted internally of said output chamber capable of pumping entrained solids small enough to pass through said screen, said pump (a) being in communication with the sump portion of said output chamber so as to draw liquid therefrom at a height below the bottom of said input chamber, and
(b) having a discharge conduit extending through the upper portion of said output chamber adapted for selective connection to an overboard discharge conduit.

* * * * *